US009625199B2

(12) United States Patent
Antoine et al.

(10) Patent No.: US 9,625,199 B2
(45) Date of Patent: Apr. 18, 2017

(54) METHODS AND APPARATUS FOR ADJUSTING ICE SLAB BRIDGE THICKNESS AND INITIATE ICE HARVEST FOLLOWING THE FREEZE CYCLE

(71) Applicant: Manitowoc Foodservice Companies, LLC., Manitowoc, WI (US)

(72) Inventors: Thomas H. Antoine, Port Washington, WI (US); Curt R. Cayemberg, Manitowoc, WI (US); Dean M. Petersen, Manitowoc, WI (US); Mark P. Giebel, Manitowoc, WI (US)

(73) Assignee: MAINITOWOC FOODSERVICE COMPANIES, LLC, Manitowoc, WI (US)

( * ) Notice: Subject to any disclaimer, the term of this patent is extended or adjusted under 35 U.S.C. 154(b) by 400 days.

(21) Appl. No.: 13/901,128

(22) Filed: May 23, 2013

(65) Prior Publication Data

US 2014/0013781 A1 Jan. 16, 2014

Related U.S. Application Data

(60) Provisional application No. 61/670,291, filed on Jul. 11, 2012.

(51) Int. Cl.

| | |
|---|---|
| ***F25C 1/00*** | (2006.01) |
| ***F25C 1/12*** | (2006.01) |
| ***F25C 1/22*** | (2006.01) |

(52) U.S. Cl.

CPC ..... *F25C 1/00* (2013.01); *F25C 1/12* (2013.01); *F25C 1/22* (2013.01); *F25C 2400/14* (2013.01); *F25C 2700/04* (2013.01)

(58) Field of Classification Search

CPC ..... F25C 1/00; F25C 1/12; F25C 1/22

See application file for complete search history.

(56) References Cited

U.S. PATENT DOCUMENTS

| | | | | |
|---|---|---|---|---|
| 3,877,242 A | | 4/1975 | Creager | |
| 4,185,467 A | * | 1/1980 | Garland | 62/81 |

(Continued)

FOREIGN PATENT DOCUMENTS

| | | | | |
|---|---|---|---|---|
| DE | 19514566 A1 | * | 10/1996 | G01F 23/14 |
| JP | S5415347 U | | 1/1979 | |

(Continued)

OTHER PUBLICATIONS

Ceritified Translation for Yoshida (JP-62009070).*

(Continued)

*Primary Examiner* — Allana Lewin Bidder
*Assistant Examiner* — Antonio R Febles
(74) *Attorney, Agent, or Firm* — Ohlandt, Greeley, Ruggiero & Perle, LLP

(57) ABSTRACT

A method and apparatus for adjusting and controlling ice bridge slab thickness and/or initiation of ice harvest following a freeze cycle. This adjusting and controlling is performed through the use of adjustable float clip assemblies which set the amount of water available for ice making in a batch process. The adjustable float clip assemblies provide an ice machine user with the ability to easily adjust the ice slab bridge thickness to a single or plurality of settings, and allow for changes in ice bridge slab thickness at the site of installation.

12 Claims, 8 Drawing Sheets

(56) References Cited

U.S. PATENT DOCUMENTS

| | | | | | |
|---|---|---|---|---|---|
| 4,265,598 | A | * | 5/1981 | Brand | 417/40 |
| 4,341,087 | A | | 7/1982 | Van Steenburgh, Jr. | |
| 4,869,076 | A | | 9/1989 | Sakai et al. | |
| 4,903,506 | A | * | 2/1990 | Delisle et al. | 62/347 |
| 5,586,439 | A | * | 12/1996 | Schlosser et al. | 62/78 |
| 5,829,257 | A | * | 11/1998 | Newman et al. | 62/73 |
| 5,937,455 | A | * | 8/1999 | Donati | 4/665 |
| 6,112,533 | A | * | 9/2000 | Kato et al. | 62/188 |
| 6,148,633 | A | * | 11/2000 | Yamada et al. | 62/347 |
| 6,209,340 | B1 | * | 4/2001 | Lu | 62/347 |
| 6,324,863 | B1 | * | 12/2001 | Henry | 62/347 |
| 6,681,580 | B2 | | 1/2004 | Shedivy et al. | |
| 6,730,865 | B1 | * | 5/2004 | Hernandez-Zelaya | 200/84 R |
| 6,786,091 | B1 | * | 9/2004 | Aleali | 73/309 |
| 6,907,744 | B2 | * | 6/2005 | Miller et al. | 62/74 |
| 7,484,409 | B2 | * | 2/2009 | Dykstra et al. | 73/319 |
| 7,521,639 | B1 | * | 4/2009 | Ward | 200/84 R |
| 2002/0020177 | A1 | * | 2/2002 | Billman et al. | 62/135 |
| 2010/0139305 | A1 | | 6/2010 | Ota et al. | |

FOREIGN PATENT DOCUMENTS

| | | | |
|---|---|---|---|
| JP | S6033182 | U | 3/1985 |
| JP | S629070 | U | 1/1987 |
| JP | S62299666 | U | 12/1987 |
| JP | S6340772 | U | 3/1988 |
| JP | 2004036951 | A | 2/2004 |
| JP | 2006029626 | A | 2/2006 |
| TW | 201132917 | A | 10/2011 |

OTHER PUBLICATIONS

European Search Report dated Jul. 16, 2014 for European application No. 13174743.8.

Canadian Office Action dated Oct. 27, 2014 for Canadian application No. 2,819,742.

Mexican Office Action dated Jun. 29, 2015 for Mexican application No. MX/a.2013/007787.

Mexican Office Action Jan. 26, 2016 for Mexican application No. MX/a/2013/007787.

Mexican Office Action Aug. 1, 2016 for Mexican application No. MX/a/2013/007787.

Taiwan Search Report (English translation) dated May 21, 2015 for Taiwan application No. 102123978.

Chinese Office Action (with English translation) dated Apr. 9, 2015 for Chinese application No. 201310291417.3.

* cited by examiner

METHODS AND APPARATUS FOR ADJUSTING ICE SLAB BRIDGE THICKNESS AND INITIATE ICE HARVEST FOLLOWING THE FREEZE CYCLE

CROSS-REFERENCED APPLICATION

This application claims priority to U.S. Provisional Application No. 61/670,291, filed on Jul. 11, 2012, which is incorporated herein in its entirety by reference thereto.

BACKGROUND OF THE DISCLOSURE

1. Field of the Disclosure

The present disclosure relates to methods and apparatus for adjusting and controlling ice bridge slab thickness and initiation of ice harvest following the freeze cycle. The adjusting and controlling are performed through the use of adjustable float clip assemblies which set the amount of water available for ice making in a batch process. As such, the adjustable float clip assemblies provide an ice machine user with the ability to easily adjust the ice slab bridge thickness to one of up to five settings. The three primary settings use the general nomenclature of "low", "medium" and "high", while the remaining two settings use the nomenclature "very low" and "very high". The methods and apparatus of the present disclosure allow for changes in ice bridge slab thickness at the site of installation. Additionally, the methods and apparatuses of the present disclosure allow for more precise control of the use of water in the ice making machine during the ice making process. Finally, the methods and apparatuses of the present disclosure allow for the elimination of an ice thickness probe for determining when to initiate the harvest cycle of the ice machine for harvesting the ice.

2. Background of the Art

There are several major types of automatic ice making machines.

Predominant forms of ice produced in such machines are cubes and flakes. Cubes are preferred for cooling carbonated beverages served in cups because cube ice generally causes less foaming of the beverage. Cube ice making machines themselves come in a number of varieties. Some form individual ice cubes, while others, referred to as slab-type machines, have a grid of ice forming pockets that freeze individual cubes. Of the slab type machines, there are continuous and batch ice machines. In the continuous type ice machine, supply water continuously flows into a sump tank of the ice machine as needed and the level of water is maintained by a float device. In the batch type ice machine, supply water fills a sump tank and the water is used to make batches of ice. Once the ice is formed, the ice is harvested and the sump tank is emptied. The sump tank is refilled for the next batch of cubes. An example of a continuous type ice making machine is found in U.S. Pub. Pat. 2010/0139305. An example of a batch type ice making machine is found in U.S. Pat. No. 6,681,580.

In slab type ice making machines, generally ice is allowed to freeze over the edges of the grid to bridge between individual cubes. When it is time to harvest the cubes, the ice bridge holds the cubes together and makes the cubes all come out in one slab, thus helping to achieve a complete harvest. The thickness of the ice bridge can be controlled by adjusting an ice thickness sensor or probe. A thicker bridge may be desirable in some instances from a harvest standpoint, so that all of the cubes come out with the slab. Also, larger ice bridges may cause the ice to harvest in a shorter amount of time due to the added weight of the cubes making up the slab being held together, which helps to overcome any vacuum forces cause by the melting ice against the base of the ice-forming mold. On the other hand, thick ice bridges prevent the individual cubes from breaking apart when the ice falls into a bin. Large clumps must be broken up with a scoop before the ice can be added to a cup. Also, because the ice acts as an insulator, it takes longer to form the next incremental layer of ice the thicker the ice bridge becomes. In terms of the overall production rate of the machine, this often offsets the benefit of faster harvest times achieved with thicker ice bridges.

There are several problems with the typical batch type ice machine. Typical batch making ice machines control the ice bridge thickness with an ice thickness probe. However, any adjustment or repair to the ice thickness probe of a typical batch type ice making machine must be done by certified repair so that the ice making machine remains NSF compliant. Also, to reach a malfunctioning ice probe, at least partial disassembly of the ice machine is usually required. Additionally, in typical batch type ice making machines, the volume of water in the sump tank and used for each batch of ice is set in the factory, not allowing for user control of this factor.

SUMMARY OF THE DISCLOSURE

According to the present disclosure, methods and apparatuses are provided which allow for adjustment of the ice bridge thickness without the use of tools. According to the present disclosure, control of the ice bridge thickness is done by controlling the water volume in the sump tank through the use of two floats held in place by float clips. The water level allowed by one float in a float clip is set upon manufacture and cannot be adjusted by the user. This first float sets the minimum water level of the sump tank, and upon this float being activated (i.e. the water level has reached that set for this float), the ice harvest is commenced. This first float is connected to the controls of the ice making machine and indicates through electric signals that the ice should be harvested. This level of the first float clip (and thus the float) is set by the manufacturer so that a safe minimum amount of water remains in the ice machine sump tank when ice harvesting is initiated. This assures that the ice making machine does not continue attempting to make ice should the water level be insufficient or run out.

The second float clip is adjustable by the end user to any one of five (5) settings. The adjustable float clip adjusts the level of the second float which sets the maximum water level in the sump tank available and to be used for ice making. In this manner, the user can select the ice bridge thickness preferred for its own establishment, can conserve water, or can increase or decrease the ice making cycle time, all by the simple expedient of adjusting the second float clip (and, of course, the second float).

The use of the adjustable float clip allows for simple and quick adjustment of the float in the field by the end user and eliminates the need for special technician servicing or costly repair and down time. The use of the first float clip to set the minimum water level preferably to also signal for the initiation of harvesting allows for the elimination of an ice thickness probe to initiate the harvest cycle, and renders the manufacture and repair (if needed) more simple, without the need to disassemble the ice making machine. The use of the adjustable float clip to set the maximum water level also creates an adjustment method that is NSF compliant. In addition, the float clips and floats can be removed for cleaning without the use of tools, because in a preferred embodiment of the present disclosure, the ice float clips snap easily into and out of place and, in any event, the floats themselves can be slipped out of the clips to be cleaned or replaced. Slime buildup on the float sensors themselves is also reduced.

An additional benefit of the present disclosure includes that there is provided a batch water system which allows for more even ice fill patterns. Using an ice thickness probe (which can only measure the thickness of the ice bridge at one location) to initiate the harvest cycle of the ice making machine can result in variation in each batch of ice made (due, e.g., to the fact of potential ice buildup on the ice thickness probe itself). According to the present disclosure, by using the float clips to adjust the floats, the water usage is more consistent due to the fact that it is the quantity of water set by the end user which determines the ice bridge thickness. Only when all of the available water in the sump tank is used, and the water level drops to the level of the first float does the ice harvest cycle begin. Thus, the same amount of water is used for each cycle.

A corollary to the foregoing benefit is that the batch water system of the present disclosure reduces the energy consumption and water use. In the prior art ice making machines, excess water had to be contained in the sump tank to insure that the ice bridge thickness was reached before harvest. This excess water was then pumped out of the sump tank upon initiation of the ice harvest cycle. According to the present disclosure, only a minimum amount of water remains in the sump tank at the time of harvest, and all of the water above this level is used to make ice. This allows for the control of the amount of water which can be critical in many situations.

In more detail, the present disclosure provides an ice bridge thickness control for an ice making machine comprising a pair of floats for controlling the level of water in a water supply for the ice machine, wherein one float sets the maximum water level to for producing ice, and the other float sets the minimum water level for harvesting ice, and wherein the floats control the ice bridge thickness by setting the amount of water available for producing ice as the amount between the levels set by the two floats. The ice machine is not permitted to go into harvest mode until the minimum water level is reached. Preferably, the float setting the minimum water level also controls and causes initiation of the harvest cycle. Also preferably, the pair of floats is held by float clips, and the float clip holding the float that sets the minimum water level for harvesting ice is not adjustable and the float clip that holds the float that sets the maximum water level for producing ice is adjustable. Also preferably, the float clip that holds the float that sets the maximum water level for producing ice is adjustable to at least three (3) different levels for setting three (3) different water levels. An advantage of the ice bridge thickness control of the present disclosure is that the ice machine does not have any an ice thickness probe which directly measures the thickness of the ice bridge forming such as by, for example, direct or optical contact or observation.

In still further detail, the present disclosure also provides a method for controlling ice bridge thickness in an ice making machine. In one of its broadest aspects, the method comprises controlling the level of water in a water supply for the ice machine using a pair of floats, setting the maximum water level for producing ice by one float, setting the minimum water level for initiating harvesting ice by the second float, and producing ice until the amount of water between the levels set by the two floats is consumed making ice. Further, the methods also provide for controlling the start of harvesting by the float that sets the minimum water level for harvesting ice. In more preferred embodiments, the methods also include holding the pair of floats by float clips, with the float clip holding the float that sets the minimum water level being non-adjustable and the float clip that holds the float that sets the maximum water level being adjustable. In more preferred embodiments, the methods also include providing that the float clip that holds the float that sets the maximum water level is adjustable to at least three (3) different levels for setting three (3) different water levels. The method of the present disclosure advantageously preferably omits an ice thickness probe which directly measures the thickness of the ice bridge forming such as by, for example, direct or optical contact or observation.

BRIEF DESCRIPTION OF THE DRAWINGS

Further details, features and advantages of this invention result from the following description of an embodiment using the drawing in which.

DETAILED DESCRIPTION OF THE DISCLOSURE

The general configuration of an ice making machine of the present disclosure will be described in connection with FIGS. 1 and 2 which depict a prior art ice making machine. This description will show how the present disclosure differs from and improves upon the prior art.

Figure 1:
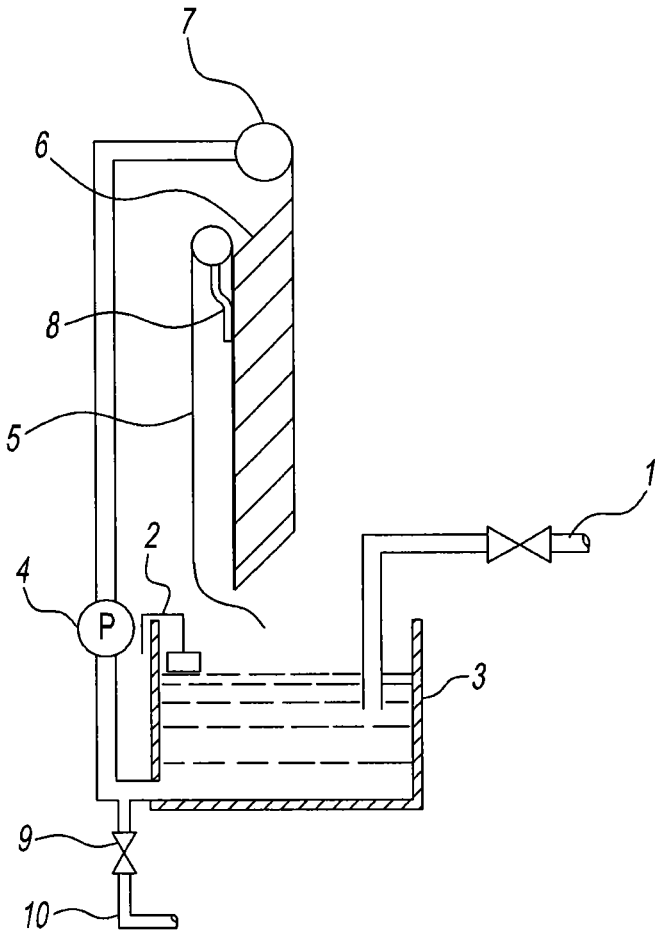
FIG. 1 Prior Art
FIG. 1 is a schematic diagram of the water system of a typical ice making machine of the prior art.

As shown in FIG. 1, the typical water system for cube ice machines includes a water supply or inlet 1. A water level probe 2 is used to control the depth of water in a sump tank 3. A circulating pump 4 draws water out of the sump and pumps it up to a distributor tube 7. Water falls from the distributor tube 7 over the ice-forming mold, sometimes also known as an evaporator plate 6. Water curtain 5 keeps water from splashing out of the front of the water compartment and directs water that does not freeze back into the sump tank 3. An ice thickness sensor or probe 8 is used to monitor the build-up of the ice bridge on the front of the ice-forming mold 6. The ice thickness sensor initiates the ice harvest cycle when a preset thickness of the ice bridge is reached. When the ice machine goes into the harvest mode, a solenoid valve 9 is opened to allow water from the sump tank to enter a drain line 10. Alternatively, the drain line 10 and solenoid 9 can be located after the pump, so that the water in the sump is pumped out to the drain.

Figure 2:
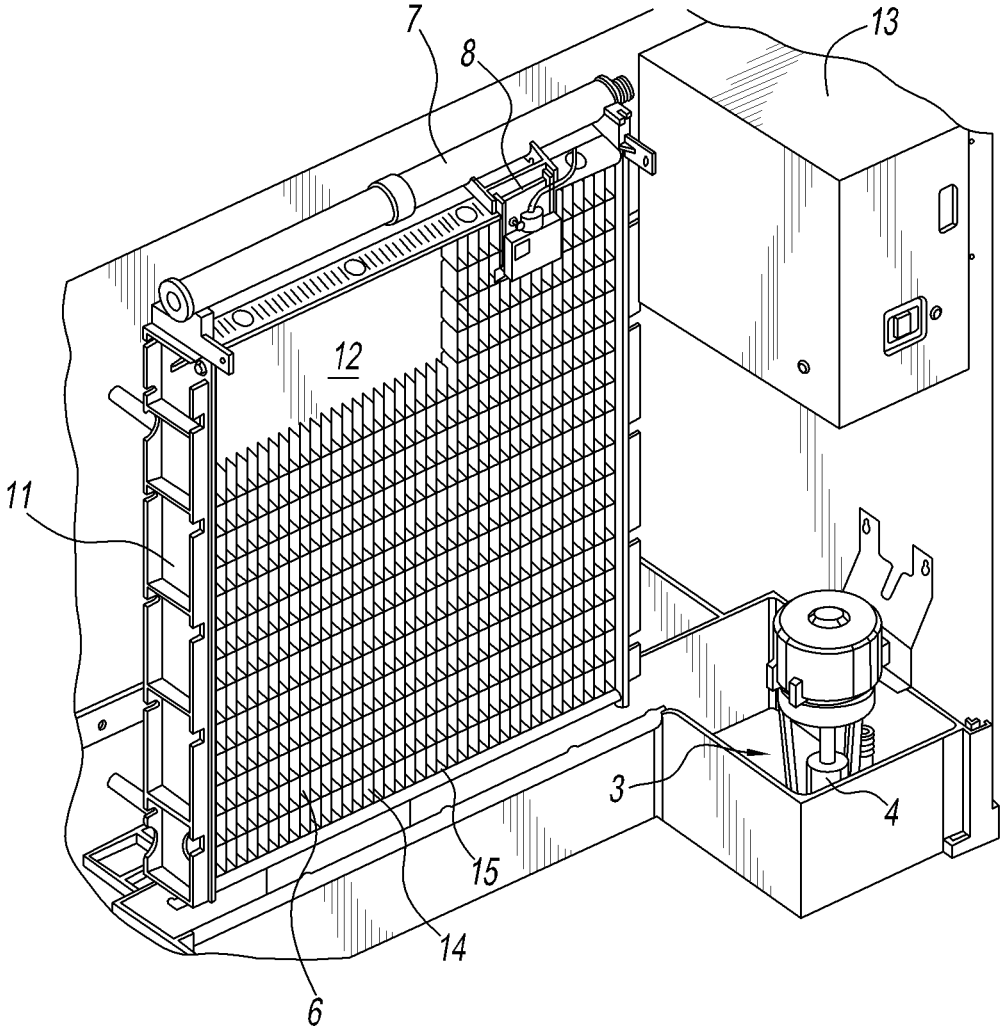
FIG. 2 is a perspective view of the ice making compartment in a typical ice making machine of the prior art; with several sections of the dividers making up the ice-forming mold removed from the evaporator assembly for sake of clarity.

FIG. 2 shows several of the above components, although the water curtain 5 is removed and other components such as the water line interconnecting the pump 4 and the distributor 7 are not shown in the perspective view of the water compartment shown in FIG. 2. FIG. 2 also shows the location of the electrical controls housed in compartment 13. The ice-forming mold is preferably part of an evaporator assembly 11, best seen in FIG. 2. The ice-forming mold itself is made up of an evaporator pan 12 and dividers 14. The evaporator tubing coils (not shown) are attached in thermal contact to the back side of the evaporator pan 12, which is preferably flat, to make up the evaporator assembly 11. The back side of the evaporator pan 12 forms the back surface of the ice-forming mold. The dividers 14 divide the area inside of the evaporator pan into pockets 15 in which individual ice cubes are frozen. The ice-forming mold has an open front face. Water runs down over this front face and wicks to the inside of the pockets 15 during the freeze mode. Water freezing over the edges of the dividers 14 forms ice bridges between the cubes frozen in the individual pockets 15. The thickness of the ice bridges and the ice cubes themselves are monitored by the ice thickness sensor 8 in the conventional manner of the prior art. When the ice bridge reaches a desired thickness, the ice machine control system, which is also conventional, triggers the ice machine to enter the harvest mode. The dividers 14 preferably include weep holes (not shown) which are known in the art. Weep holes are small openings at the base of the dividers 14 which, when the dividers 14 are attached to the evaporator pan 12, allow water to run into adjoining pockets 15 from the back, in addition to water that flows in from the open front face of the evaporator pan 12. The horizontal dividers (from the perspective of FIG. 2) have a bottom face (also from the perspective of FIG. 2) which is sloped downwardly at the front, open face of the ice-forming mold 6. This is also conventional, and in this regard gravity is used to release ice cube slabs from the ice-forming mold 6 during the harvest cycle.

FIGS. 3-9 show various views of the float clips according to the present disclosure.

Figure 3:
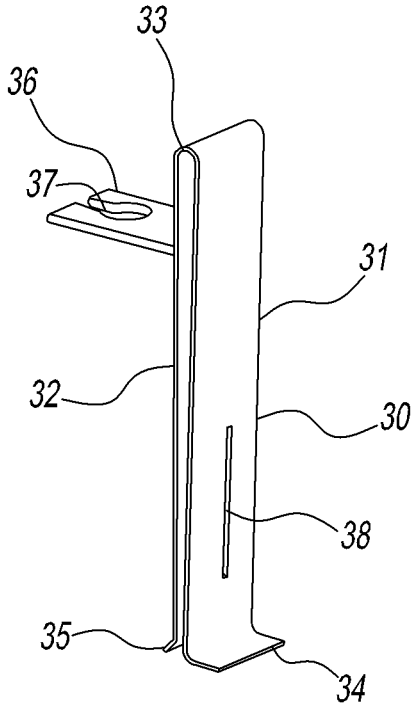
FIG. 3 is a perspective view of an adjustable float clip according to the present disclosure.

In FIG. 3, a general design of a preferred float clip according to the present disclosure is shown. In FIG. 3, float clip is generally "bobby pin" like in shape and structure. Float clip 30 has a generally flat "front" side 31 (the side external to the sump tank as will be explained further), and a generally flat "back" side 32 (the side internal to the sump tank as will also be explained further), joined by a curved portion 33. Float clip 30 also has "front" leg 34 and "back" leg 35. Legs 34 and 35 assist in placement and removal of the float clip 30 from along the side of the sump tank (as will be further explained), but can be omitted from any version of float clip 30. Curved portion 33 allows float clip 30 to be placed over the top edge of sump tank 3, as can be seen for example in FIG. 5. Curved portion 33 is preferably curved, but can be any other convenient shape, such as square or triangular. Curved portion 33 should also be made of a somewhat resilient material, such as spring steel or flexible polymer so that float clip 30 exerts some compressive force against the side walls of sump tank 3. This compressive force helps to retain float clip 30 in proper placement and alignment. Float clip 30 also has retainer element 36 and retaining opening 37 for accepting and retaining a float device (not shown). Of course, the shape and size of retaining opening 37 is dependent upon the float used, so the shape shown in FIG. 3 at 37 is of no particular import. The presence of retaining opening 37 also allows for removal of the float easily for cleaning the float clip 30 and/or cleaning the float without the need to disconnect the float from its connection(s) to the controls. Also, the presence of leg 32 is not always necessary, but is preferred for proper placement and retention of float clip 30. Finally float clip 30 has opening 38 (best seen in FIGS. 4, 5 and 8). Opening 38 is used to place and hold float clip 30 at the location desired by the end user, which will be explained more fully in connection with FIGS. 4, 5 and 8.

Figure 4:
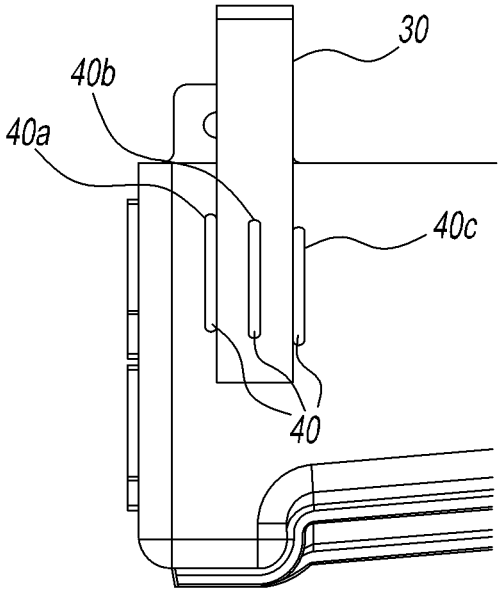
FIG. 4 is a drawing of a side view of the adjustable float clip according to the present disclosure in position on the sump tank of an ice making machine.
Figure 5:
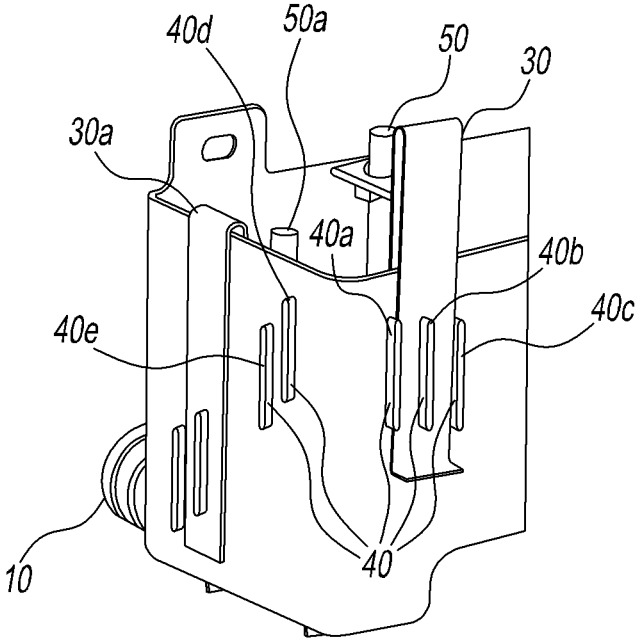
FIG. 5 is a perspective view of both the fixed and the adjustable float clips according to the present disclosure in position on the sump tank of an ice making machine.
Figure 8:
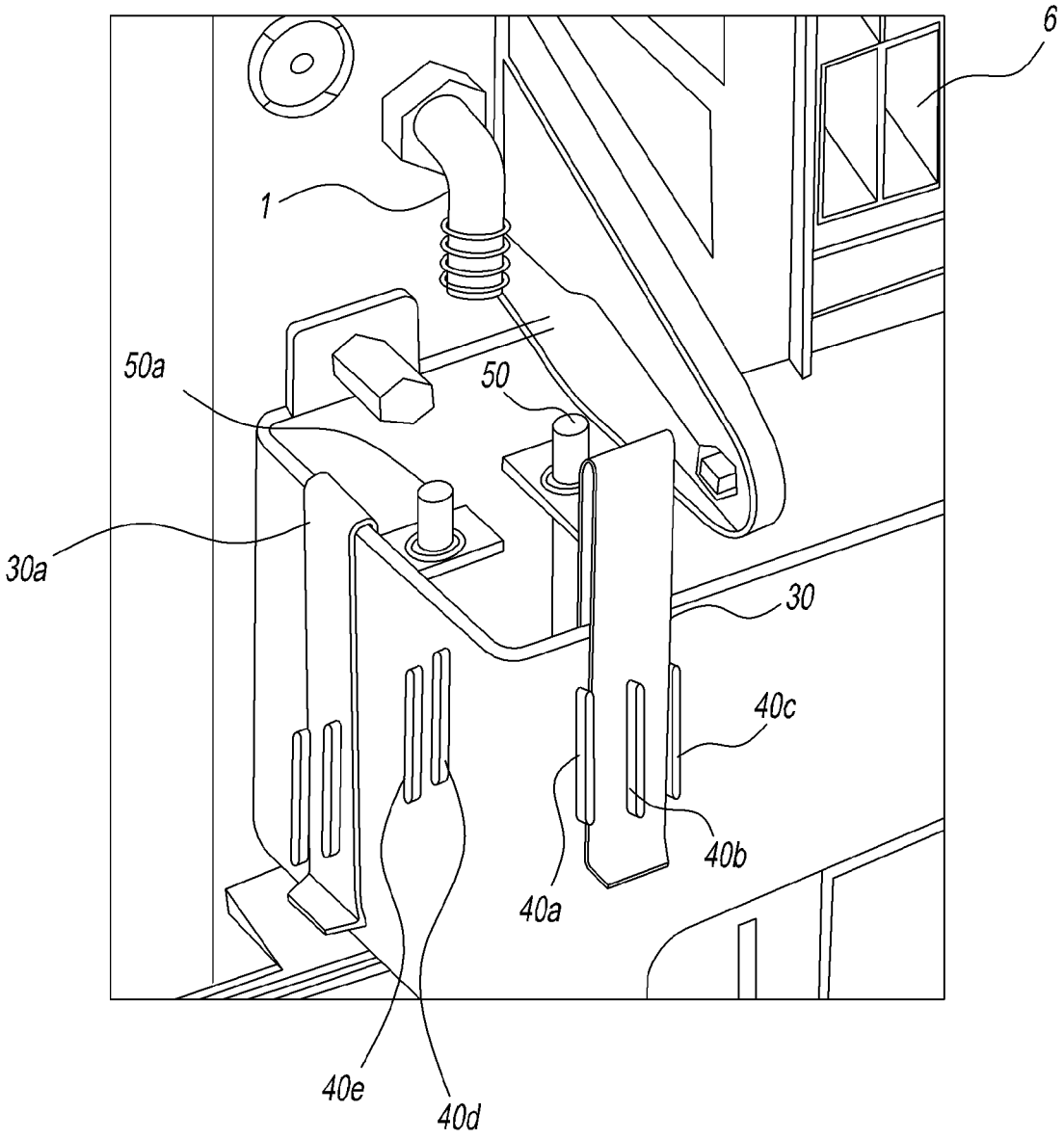
FIG. 8 is an overhead perspective view of both the fixed and the adjustable float clips according to the present disclosure in position on the sump tank of an ice making machine with evaporator in place.

FIGS. 4, 5 and 8 show two float clips 30 and **30*a* according to the present disclosure in place on a sump tank 3, and, in FIGS. 5 and 8 also show floats 50 and 50*a* in position. Float clip 30 will be referred to as the "high level" float clip (and float 50 the "high level" float) and float clip 30*a* will be referred to as the "low level" float clip (and float 50*a* the "low level" float). Float clip 30*a* (and float 50*a*) is set to its level in manufacture and cannot be adjusted. Float clip 30*a* (and accompanying float 50*a*) determines the low level of water in the sump tank 3 at which harvest is initiated. As shown in FIGS. 4, 5 and 8, sump tank 3 has pegs 40 on its external surface. Pegs 40 are provided at five (5) different heights. High level float clip 30 settings are based on the peg that is protruding through the clip. Referring to FIGS. 5 and 8, the five (5) different height settings are "high" 40*a*, "medium" 40*b* and "low" 40*c*, while the remaining two settings on the adjacent side of sump tank 3 (in FIGS. 5 and 8) are "very high" and "very low". As mentioned above, these pegs 40 and opening 38 allow the end user of the ice machine to customize the thickness of the ice bridge. Of course, the shape of the pegs shown in FIGS. 4, 5 and 8 are not the only possible design. The pegs can be essentially linear as shown in FIGS. 4, 5 and 8, but can also be two spaced pins which mate with two spaced holes on the pegs, can be "snap" type fasteners, or any other type. Preferably, as with the essentially linear pegs shown in FIGS. 4, 5 and 8, the pegs are of a shape and design which prevent the float clip from rotating or moving out of its essentially vertical alignment. Also, the pegs shown in FIGS. 4, 5 and 8 are spaced apart from each other so as to accept and create a snug fit between the distance between opening 37 and the outer edge(s) of float clip front side 31. The "higher" the high level float clip 30 setting, the thicker the ice bridge and, conversely, the "lower" the high level float clip 30 setting, the thinner the ice bridge. Also shown in FIG. 5 is drain 10. Also shown in FIG. 8 is ice-forming mold 6 and water supply 1**.

Figure 6:
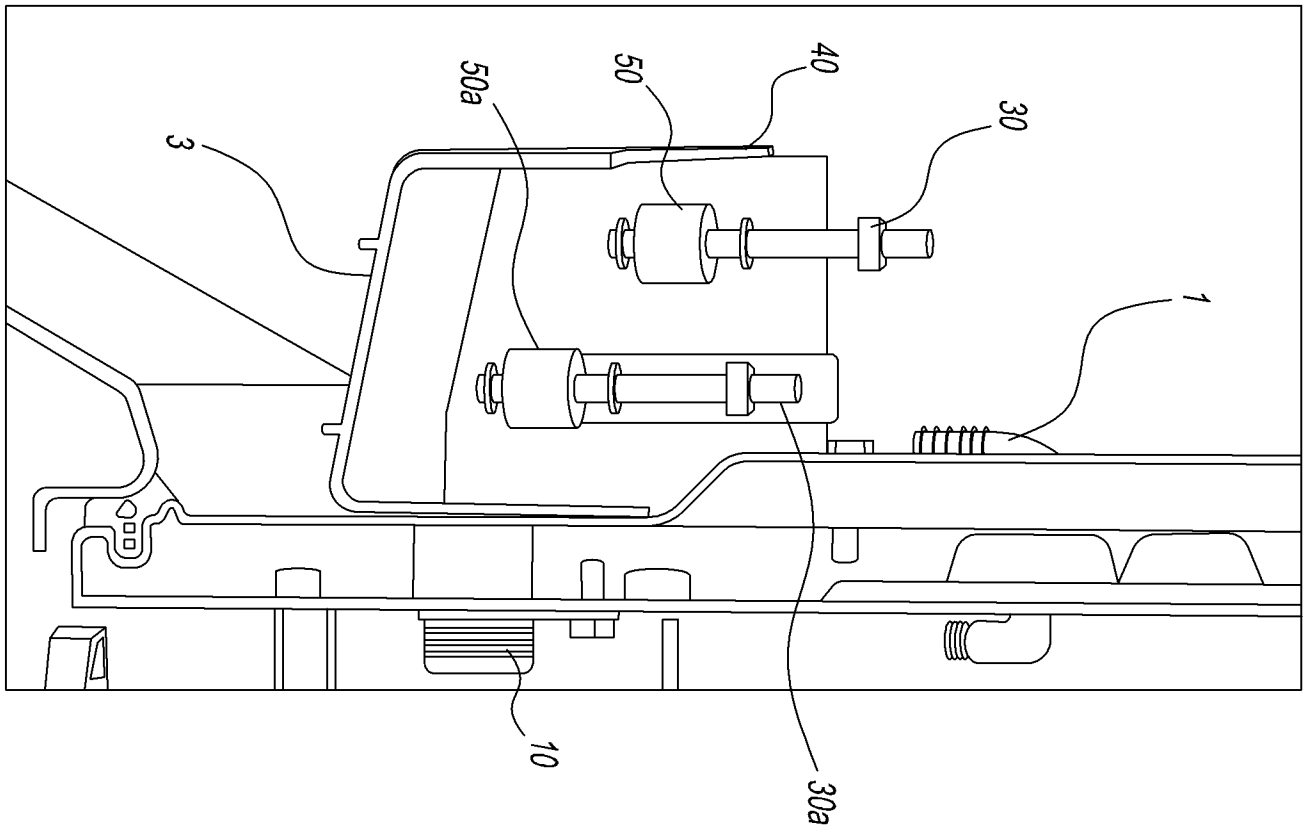
FIG. 6 is a cross-sectional view of both the fixed and the adjustable float clips according to the present disclosure in position on the sump tank of an ice making machine with evaporator removed.
Figure 7:
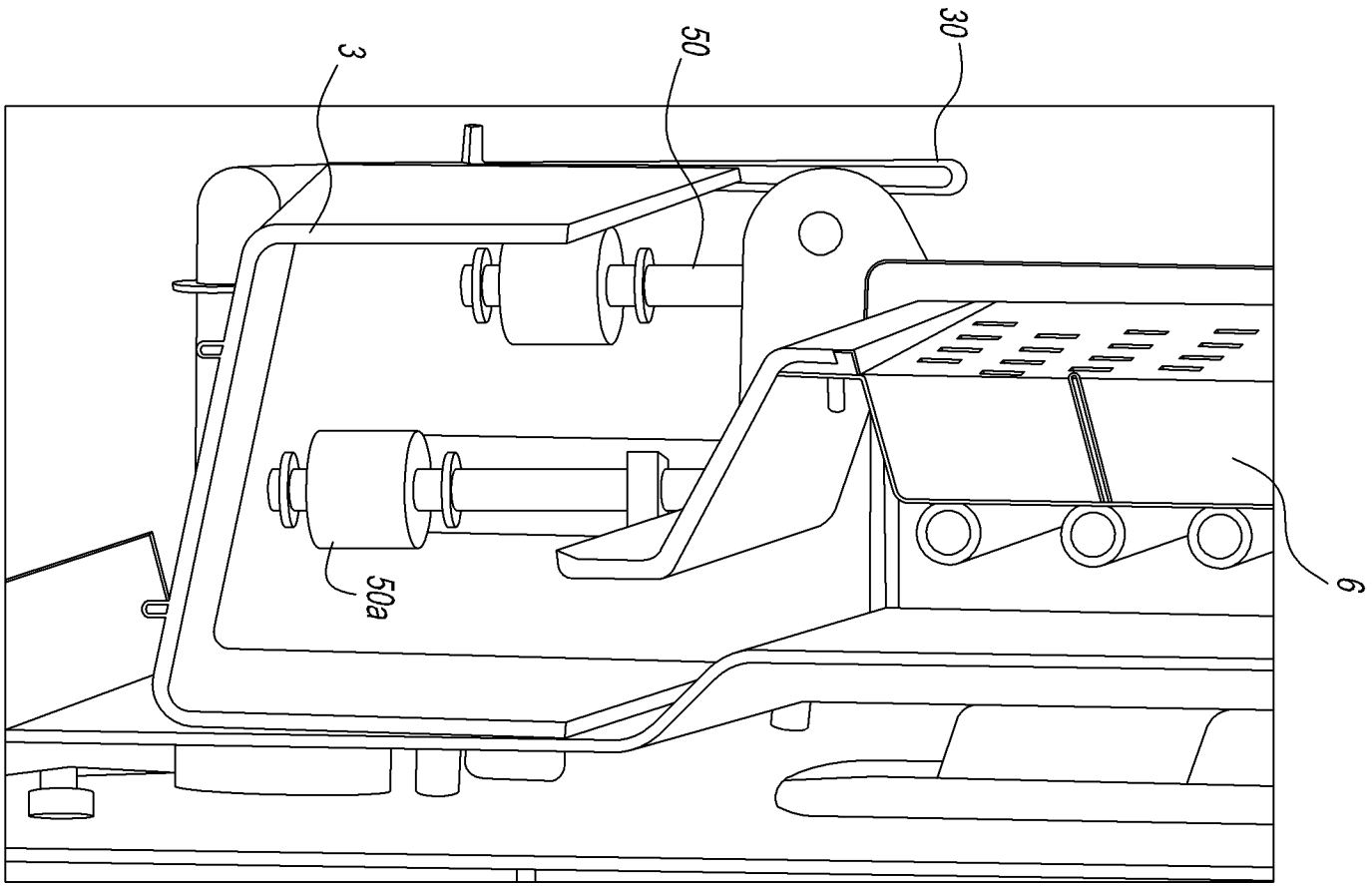
FIG. 7 is a cross-sectional view of both the fixed and the adjustable float clips according to the present disclosure in position on the sump tank of an ice making machine with evaporator in place.
Figure 9:
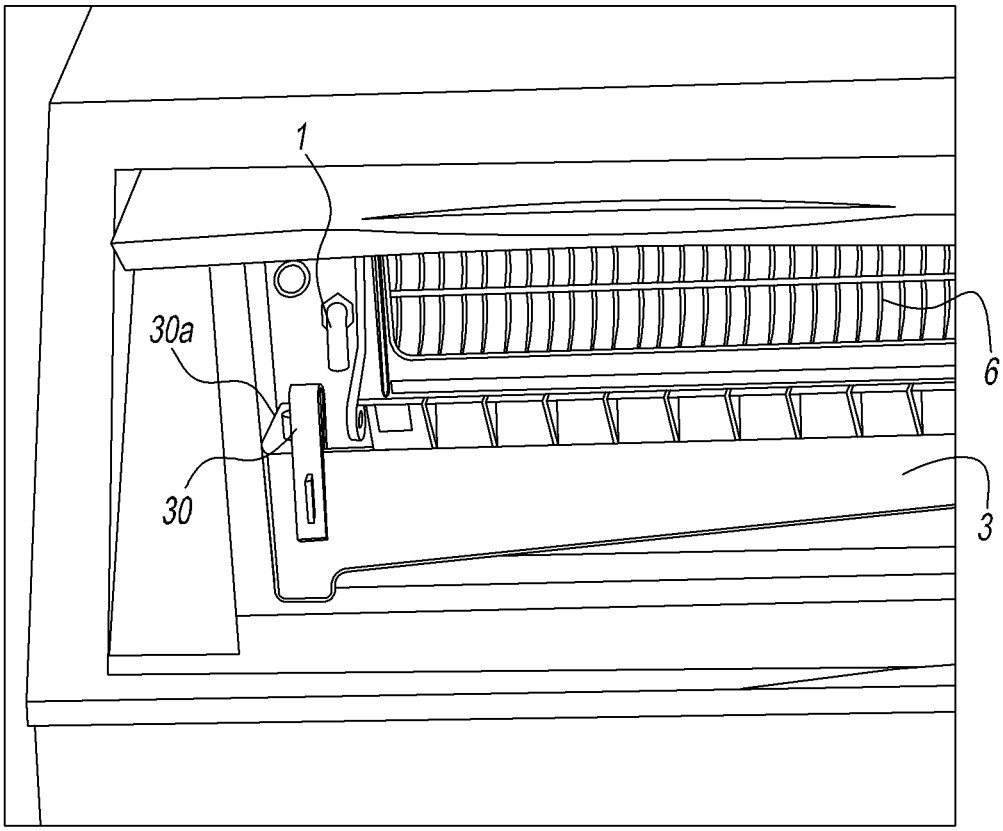
FIG. 9 is a perspective view of the customer view inside the ice storage bin of an ice machine.

FIGS. 6, 7 and 9 show additional views of float clips 30, **30*a* and floats 50, 50*a* in place on sump tank 3. In FIGS. 6, 7 and 9, additional elements previously described are indicated as well. The float clips 30 and 30*a*, floats 50 and 50*a*, water supply 1, drain 10 and ice-forming mold 6 operate in the following manner to produce ice cubes. Starting from an operating mode, sump tank 3 has been filled with water to the level chosen by the end user by setting float clip 30 and thus the height of float 50. Water is pumped through pump 4 to distributor 7 and distributed over ice-forming mold 6. Water collects in pockets 15 and freezes due to the contact of evaporator coils in contact relationship adjacent the back side of evaporator pan 12. Excess water that is not frozen and retained in pockets 15 passes down the face of ice-forming mold 6 and returns to sump tank 3 where it is recycled back to distributor 7. This process continues until the water level in sump tank 3 reaches the level preset by float clip 30***a* and float 50*a*. At this time, float 50*a* (which is in communication with control 13 of the ice machine) sends a signal to control 13 to begin harvesting the ice cubes. Also, when harvest occurs, solenoid valve 9 opens and sump tank 3 empties through drain 10. When sump tank 3 empties, solenoid valve 9 closes. When harvest is complete, water supply 1 is opened, and sump tank 3 is again filled to the level set by the user's placement of float clip 30 and float 50. When sump tank 3 is filled to the water level set by the end user, pump 4 is started and the ice making cycle begins again.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims.

All of the patents referred to herein are incorporated herein as if set forth herein in their entirety.

What is claimed is:

1. An ice bridge thickness control for a batch water system ice making machine, wherein said ice making machine has a grid of ice-forming pockets to freeze individual cubes, and wherein said pockets comprise edges between said individual cubes, said control comprising:

at least two floats for setting a volume of water used for making ice in a water supply for the ice making machine, wherein said at least two floats comprise an upper float that sets a maximum water level of the volume of water in a sump tank used for producing ice, and a lower float that sets a minimum water level of the volume of water in the sump tank used for producing ice, and wherein said volume of water between said upper and lower floats is used to produce ice and control said ice bridge thickness over said edges of said ice-forming pockets; and at least two float clips, wherein each of said at least two float clips has a front side configured to hold each of said at least two floats in the sump tank and at least the float clip holding the upper float has a back side configured to engage one of a plurality vertically spaced protrusions external to the sump tank, wherein said float clip holding said upper float is vertically adjustable by engaging protrusions at different vertical levels, and wherein said float clip holding said lower float is not vertically adjustable.

2. An ice bridge thickness control according to claim 1, wherein said lower float further controls the start of said ice harvesting.

3. An ice bridge thickness control according to claim 1, wherein each of said at least two float clips has a retaining opening on its front side configured to hold one of said at least two floats.

4. An ice bridge thickness control according to claim 3, wherein said upper float clip is vertically adjustable to at least three (3) different positions by engaging protrusions at three different vertical levels, and wherein each position corresponds to a different maximum water level for the volume of water used to produce ice.

5. An ice bridge thickness control according to claim 3, wherein said upper and lower floats are removable from said float clips without disconnecting said float clips from the control.

6. A method of controlling ice bridge thickness in a batch water system ice making machine, wherein said ice making machine has a grid of ice-forming pockets to freeze individual cubes, and wherein said pockets comprise edges between said individual cubes, said method comprising:

providing at least two floats for setting a volume of water used for making ice in a water supply in a sump tank for the ice machine, wherein said at least two floats comprise an upper float and a lower float;

setting a maximum water level of the volume of water in the sump tank used for producing ice by said upper float;

setting a minimum water level of the volume of water in the sump tank used for producing ice by said lower float;

providing at least two float clips, wherein each of said at least two float clips has a front side configured to hold each of said at least two floats in the sump tank and at least the float clip holding the upper float has a back side configured to engage one of a plurality of vertically spaced protrusions external to the sump tank, wherein said float clip holding said upper float is vertically adjustable by engaging protrusions at different vertical levels, and wherein said float clip holding said lower float is not vertically adjustable; and producing ice until the volume of water between the levels set by said upper and lower floats is consumed, wherein said volume of water between said upper and lower floats controls said ice bridge thickness over said edges of said ice-forming pockets.

7. A method of controlling ice bridge thickness in an ice making machine according to claim 6, further comprising controlling the initiation of harvesting of ice by the position of said lower float in said water supply.

8. A method of controlling ice bridge thickness in an ice making machine according to claim 6, wherein each of said at least two float clips has a retaining opening on its front side configured to hold one of said at east two floats.

9. A method of controlling ice bridge thickness in an ice making machine according to claim 8, wherein said upper float clip is vertically adjustable to at least three (3) different positions by engaging protrusions at three different vertical levels, and wherein each position corresponds to a different maximum water level used to produce ice.

10. A method of controlling ice bridge thickness in an ice making machine according to claim 8, wherein said upper and lower floats are removable from said float clips without disconnecting said float clips from the control.

11. An ice bridge thickness control according to claim 4, wherein said upper float clip is vertically adjustable to five (5) different positions, wherein each position corresponds to a different maximum water level for the volume of water used to produce ice.

12. A method of controlling ice bridge thickness in an ice making machine according to claim 9, further comprising providing that said float clip associated with said upper float is vertically adjustable to five (5) different positions, wherein each position corresponds to a different maximum water level.

* * * * *